US007854085B1

(12) United States Patent
Hodgkins et al.

(10) Patent No.: US 7,854,085 B1
(45) Date of Patent: Dec. 21, 2010

(54) GUN BARREL ATTACHMENT

(75) Inventors: Knowlton Hodgkins, Deerfield, MA (US); Anthony E. Souza, West Chesterfield, NH (US)

(73) Assignee: Highlander Security Consulting, L.L.C., Spofford, NH (US)

( * ) Notice: Subject to any disclaimer, the term of this patent is extended or adjusted under 35 U.S.C. 154(b) by 374 days.

(21) Appl. No.: 12/012,468

(22) Filed: Feb. 4, 2008

(51) Int. Cl.
*F41C 27/16* (2006.01)

(52) U.S. Cl. ..... 42/85; 89/14.2

(58) Field of Classification Search ..... 89/14.2, 89/14.3, 14.4, 198; 42/1.06, 79, 90, 53, 86, 42/106, 52; D22/108
See application file for complete search history.

(56) References Cited

U.S. PATENT DOCUMENTS

| | | | | | |
|---|---|---|---|---|---|
| 2,546,242 | A * | 3/1951 | Stinson | ..... | 42/146 |
| 3,950,877 | A * | 4/1976 | Musgrave | ..... | 42/90 |
| 5,425,299 | A * | 6/1995 | Teetzel | ..... | 89/14.4 |
| 5,433,133 | A * | 7/1995 | La France | ..... | 89/14.2 |
| 5,685,102 | A * | 11/1997 | Latka | ..... | 42/85 |
| 7,305,788 | B1 * | 12/2007 | McLain | ..... | 42/1.08 |
| 7,353,740 | B1 * | 4/2008 | Hoffman | ..... | 89/14.05 |
| D577,409 | S * | 9/2008 | Brittingham | ..... | D22/108 |
| 7,578,090 | B1 * | 8/2009 | Romaszka | ..... | 42/96 |
| 7,661,349 | B1 * | 2/2010 | Brittingham | ..... | 89/14.4 |
| 2006/0060076 | A1 * | 3/2006 | Dueck et al. | ..... | 89/14.4 |
| 2007/0095198 | A1 * | 5/2007 | Dater et al. | ..... | 89/14.2 |

OTHER PUBLICATIONS

Pages 1-6 from the Yankee Hill Machine Company, Inc website via http://web.archive.org/web/20061109082007/www.yankeehillmachine.com/store/muzzle.html dated Nov. 9, 2006.*

* cited by examiner

*Primary Examiner*—Benjamin P Lee
(74) *Attorney, Agent, or Firm*—Joanne M. Martin

(57) ABSTRACT

A tubular or cylindrical member attached to the discharge end of a gun barrel or to any item attached to the discharge end of a gun barrel, e.g. a muzzle brake, silencer, etc., and typically includes a leading edge having a series of distinct, sharp, knife-like edges and a corresponding series of recesses oriented along the axis of the attachment, the recesses typically being between the sharp edges.

18 Claims, 3 Drawing Sheets

GUN BARREL ATTACHMENT

FIELD OF THE INVENTION

The present invention relates to devices attached to gun barrels, in particular to gun end of barrel attachments providing additional functionality and enhanced utility on the gun.

BACKGROUND OF THE INVENTION

Close-range utility of firearms, particularly rifles or weapons with extended barrels is typically limited to the discharge of the weapon preferably at soft targets or more distant hard targets, or to poke the target with the barrel free end. When the barrel directly contacts an animate target, the typically blunt end provides no direct pain or threat of pain except for the delivery of the fired projectile. However, in many peace-keeping situations, it is desirable to provide a greater amount of motivation with non-lethal contact to cause the animate target to comply without resorting to discharge of the weapon.

A further close-range application of firearms occurs when specific hard targets, e.g. a door lock, is to be disabled, which aim would be aided by directly contacting gun barrel to the hard target. However, gun barrels and typical attachments, e.g. silencers, do not facilitate such contact as they are rounded or have smooth surfaces, and would be destroyed or damaged by fly-back of debris from the projectile impact, possibly rendering the firearm inoperative.

SUMMARY OF THE INVENTION

The gun barrel attachment according to the present invention comprises a tubular or cylindrical member attached to the discharge end of a gun barrel or to any item attached to the discharge end of a gun barrel, e.g. a muzzle break, silencer, etc., and typically includes a leading edge having a series of distinct, sharp, knife-like edges and a corresponding series of recesses oriented along the axis of the attachment, the recesses typically being between the sharp edges.

The gun barrel attachment according to the present invention includes different embodiments, such as a one having separate leading edge member including the sharp edges, and a retainer member which attaches to the gun barrel (or any interposed element such as a silencer, etc.) into which the leading member is slidable therein and axially spring loaded to provide some resilient movement when the leading member contacts a surface and force is applied to the gun barrel. Another embodiment integrates the leading member and the retainer member into a single gun barrel attachment member which, in one embodiment includes a slot along the perimeter thereof in a direction of the axis of the gun barrel attachment, which secures to the gun barrel (or intervening device) by screws drawing the slot together thus securing the gun barrel attachment.

A still further embodiment includes an internal opening dimensioned to receive a rifle muzzle break and includes a slot and screws through the both sides of the slot to compress the device around the muzzle break, and further includes slots extending parallel to the axis of the gun barrel. The slots are dimensioned to overlay the openings in the muzzle break.

BRIEF DESCRIPTION OF THE DRAWING

These and further features of the present invention will be better understood by reading the following Detailed Description together with the Drawing, wherein.

DETAILED DESCRIPTION OF THE EXEMPLARY EMBODIMENTS

Figure 1:
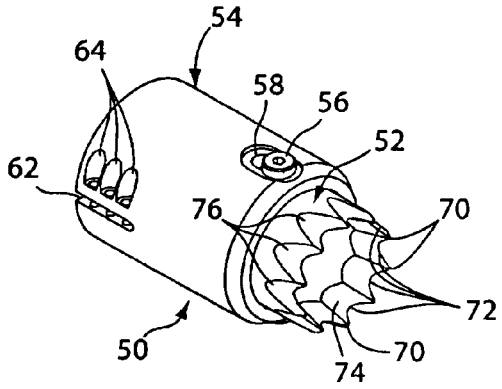
FIG. 1 is a perspective view of one embodiment of the present invention.
Figure 3:
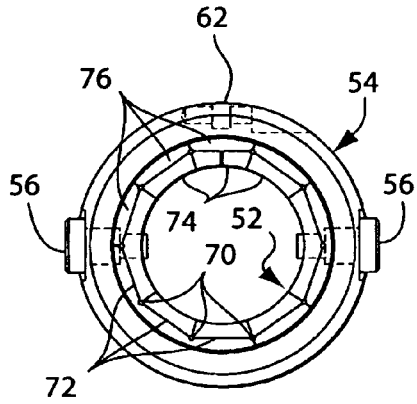
FIG. 3 is an end elevation of the embodiment of FIG. 1.
Figure 2:
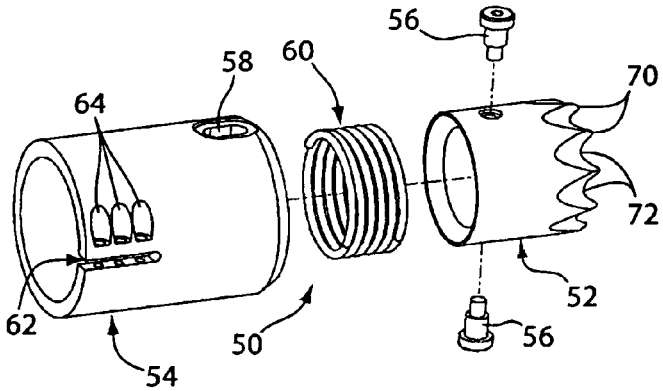
FIG. 2 is an exploded perspective view of the embodiment of FIG. 1.
Figure 4:
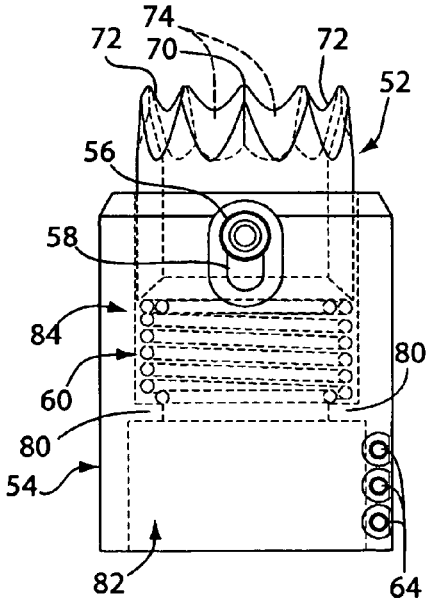
FIG. 4 is a side elevation of the embodiment of FIG. 1.
Figure 5:
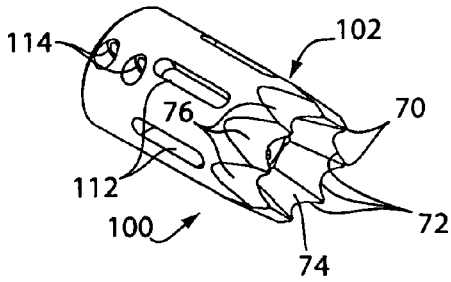
FIG. 5 is a perspective view of a second embodiment of the present invention.

A first exemplary embodiment 50 is shown in FIG. 1, and in other views in FIGS. 2-4, comprising a tubular assembly of a forward member 52 retained in a rear attachment member 54 by pins 56 axially movable in a corresponding slot 58. The attachment member 54 secures to a gun barrel or item mounted on the gun barrel (not shown) by circumferential compression provided by a slot 62 extending generally substantially perpendicular to the circumference and typically substantially parallel to the axis of the gun barrel, where the confronting slot 62 sides are drawn together with screws 64 or other suitable device. The exposed end of the forward member is formed to provide a series of serrated or scalloped knife-like edges 72 separated by points 70, which in embodiment 50 are sharpened or pointed. The edges are typically formed by milling or other suitable forming process top reduce the thickness of the forward member 52 by providing inner reduced surfaces 74 and outer reduced surfaces 76, although alternate embodiments may have a single set of reduced surfaces. A preferred embodiment of the edges 72 reveal a scallop, recess having an approximate radius 78 of 0.20", and when the inner and outer reduced surfaces 74, 76 are formed by a milling cutter having a cutting surface angled (e.g. a 15° taper from a cylindrical surface) the edges 72 tend to depart from a segment of a circle, and the inner and outer reduced surfaces 74, 76 are somewhat concave in relation to the angle and radius of the tool used to remove material to form the inner and outer reduced surfaces 74, 76. The scallop recess of the sharp edges 72 together with the number of recessed sharp edges 72 provide sufficient area to allow barrel gasses to escape upon firing were at least substantially all of the points 70 in contact with a target surface. Alternate embodiments include different curvature profile and curvature depth of the sharp edges 72 and reduced surfaces 74, 76, and may include slots thereon.

The embodiment 50 is shown in an exploded view in FIG. 2, which reveals a spring 60 which is retained and compressed between the forward member 52 and the attachment member 54. The pins 58 slide within the slot 58 and retain the forward member within the attachment member 58, and permits movement to further compress the spring 60 upon application of an axial force across the gun barrel attachment, such as when the firearm is pressed against a target.

An elevation view into the open forward end of the gun barrel attachment embodiment 50 is shown in FIG. 3, with the relationship of the outer and inner reduced surfaces 74, 76 and the intervening sharp edges 72 and juxtaposed ends 70. The pins 56 pass through the attachment member 54 and are secured to the forward member 52.

A side elevation view is shown in FIG. 4 with the inner surfaces shown in phantom. The attachment member 54 includes an opening 82 into which the weapon barrel (not shown, or any item attached to the end of the barrel) is secured by screws in apertures 64 acting to close the slot 62 (FIGS. 1, 2, 3). A reduced diameter stop, or collar, 80 is formed at the inner end of the opening 82 to limit forward movement of the barrel, and provide a stop against which the spring 60 seats within a recess 84. In the embodiment shown, the recess 84 extends to the end of the attachment member opposite the opening 82, and is dimensioned to receive the forward member 52 therein.

A second exemplary embodiment 100, mountable on a rifle muzzle brake, is shown in FIGS. 5-8, comprising a unitary structure 102 including a leading circumference of sharp edges 70 as above with respect to the embodiment 50 and surfaces adapted to secure to the elements (muzzle brake) attached to the end of the barrel. The embodiment 100 further includes inner and outer reduced surfaces 74, 76 and points 70 between adjacent rearwardly (toward screws 114) recessed sharp edges 72 as described above with regard to embodiment 50. The recessed sharp edges form serrated or scalloped "teeth" which have a radius of approximately 0.20" in the embodiment shown, and are somewhat shaped in a hyperbola or other non-circular manner depending on the formation of the inner and outer reduced surfaces 74, 76, as discussed above with regard to embodiment 50. Typically, muzzle brakes such as found on M-16 type weapons, have elongated slots through which gas is conducted, and the corresponding embodiment 100 of the present invention also includes matching elongated slots 112 which when mounted, overlay the slots on the gun muzzle brake (not shown). The embodiment 100 shows 6 such slots 112, and alternate embodiments may vary in number, size and shape according to the gun element which receives the attachment.

Figure 7:
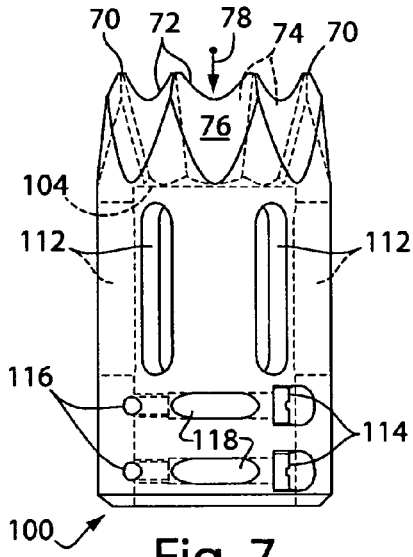
FIG. 7 is a side elevation of the embodiment of FIG. 5.
Figure 6:
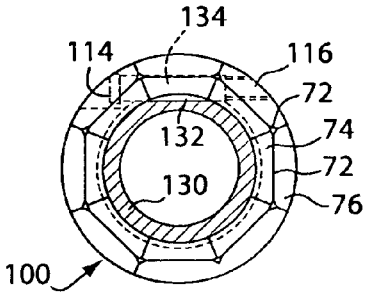
FIG. 6 is an end elevation of the embodiment of FIG. 5.
Figure 8:
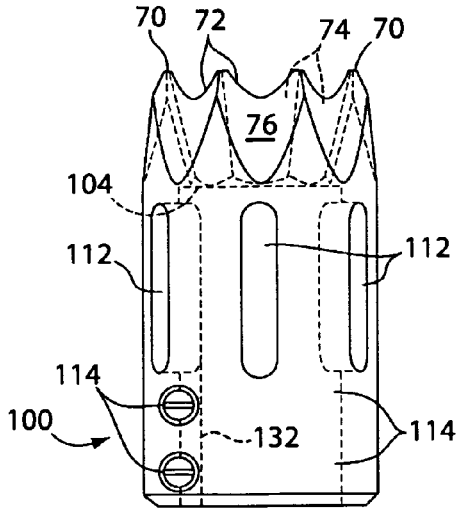
FIG. 8 is a side elevation of the embodiment of FIG. 5 offset 90° from the view of FIG. 7.

As shown in FIG. 6, a portion of the muzzle brake is shown in cross-section 130 (the outer region being defined in phantom) having at least one flat portion 132 (also FIG. 8) which is engaged by a substantially tangential screw (or pin) 114, the body 134 of which passes through a correspondingly sized passage to engage a threaded portion 116 of the structure 102, wherein the body 134 emerges through slots 118 (FIG. 7) to engage the flat portion 132 of the muzzle brake 130, and secure it thereto. As shown in FIGS. 6 and 7, the inner reduced surfaces form an internal diameter smaller than the outer edge of the muzzle brake forming a lip 104 against which the muzzle brake (or element on the end of the barrel) seats.

Figure 9:
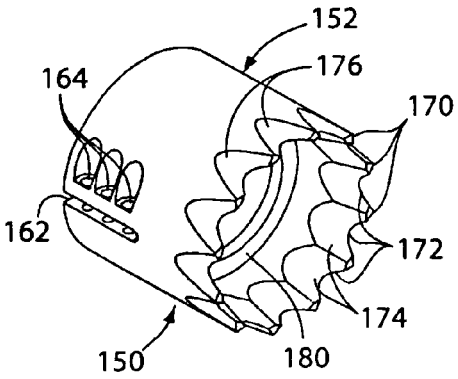
FIG. 9 is a perspective view of a third embodiment of the present invention.
Figure 10:
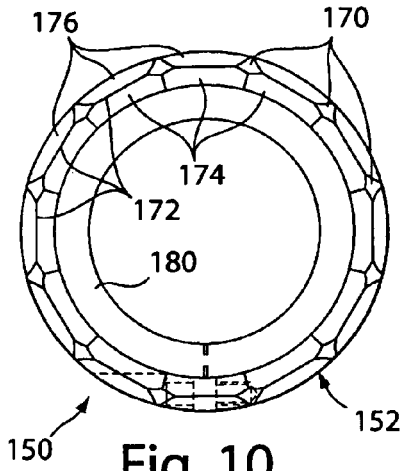
FIG. 10 is an end elevation of the embodiment of FIG. 9.
Figure 11:
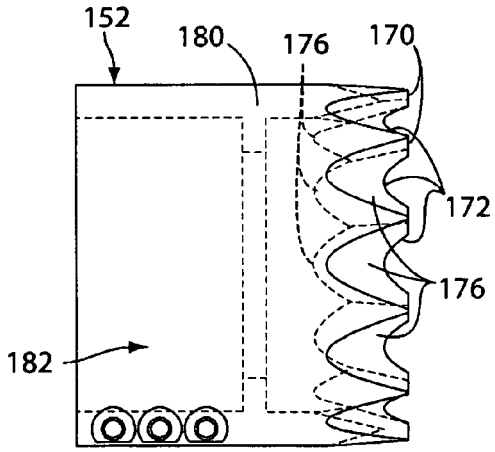
FIG. 11 is a side elevation of the embodiment of FIG. 9.

A further embodiment 150 is shown in FIGS. 9-11 comprises a unitary structure 152 having inner and outer reduced surfaces 174, 176 intersect to form sharp edges 172; however, the intervening regions 170 are optionally formed not into sharpened regions, but are truncated points having flat regions thereon. Alternate embodiments include sharpened points in place thereof. As shown for the embodiment 50, the unitary structure 152 secures to a gun barrel supporting member, e.g. a silencer (or other barrel device or directly to the barrel) by circumferential compression provided by a slot 162 and screws through openings 164 to draw the circumference around the barrel supporting member which draw the slot closed as the screws are tightened.

The unitary structure 152 of the embodiment 150 receives the barrel supporting member into opening 182 (FIG. 11) against shoulder 180 which serves as a stop to facilitate transfer of more force from the gun barrel to the sharp edges 72 without slippage of the structure 152 over the barrel supporting member. The shoulder 180 inner dimension is less that the inner dimension of opening 182 and large enough to avoid interference with the operation of the weapon and barrel supporting member, e.g. a silencer.

Figure 12:
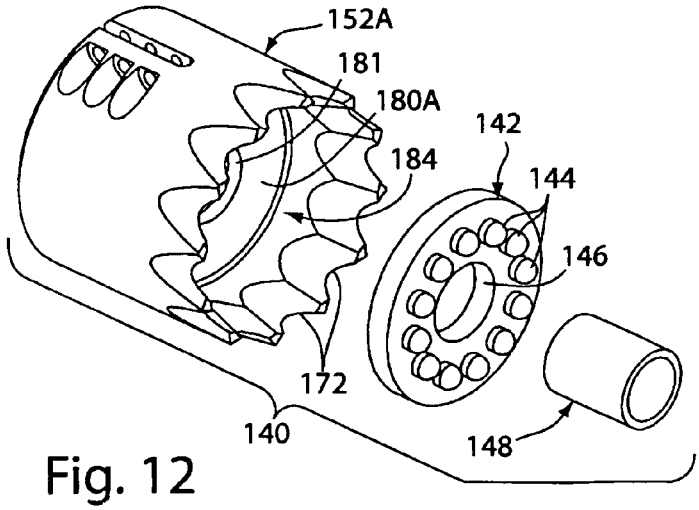
FIG. 12 is a perspective expanded view of an alternate embodiment of the present invention.

An alternate embodiment 140 shown in FIG. 12 includes a rear attachment member 152A substantially the same as rear attachment member 152 of the embodiment 150 described above, except that the forward member includes a forward opening 184 dimensioned to receive a light ring 142 therein, and a the inner opening 181 of shoulder 180A is dimensioned to receive the outer surface of a tube 148 and allow it to be press-fit, screwed or otherwise fastened therein. The light ring 142 comprises a light source such as a plurality of LEDs 144 (or other suitable light source) oriented to provide a forward directed (toward the sharp edges 172) source of IR, visible or other spectrum light and is disposed on a retaining member which has an inner opening 146 which is secured in the forward opening 184 and powered by an internal or external power source (not shown). The tube 148 may also be shouldered, flared, or otherwise adapted to retain the light ring 142 in the forward opening 148.

Figure 13:
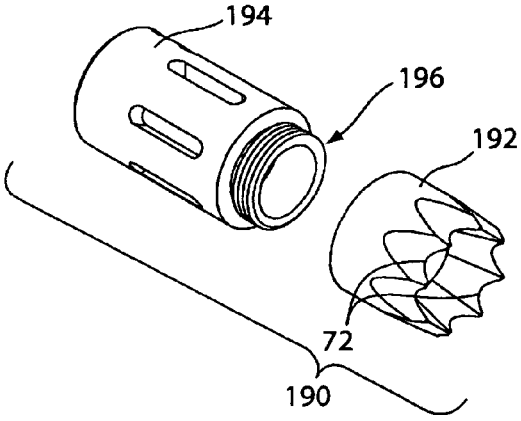
FIG. 13 is a perspective expanded view of a further alternate embodiment of the present invention.

A further alternate embodiment 190 of FIG. 13 shows a feature applicable to other embodiments according to the present invention, comprising a forward member 192 and a rear attachment member 194 removably attached, e.g. by a screw thread 196 shown in the exemplary embodiment as disposed on the rear attachment member 194. The screw thread 196 engages a complementary threaded recess (not shown) within the opening forward member 192 axially distal from the sharp edges 72. The materials of the members 192 and 194 can comprises differing metals, e.g. steel, aluminum, etc and sufficiently strong synthetic or composite materials. Connection devices other than the screw thread 196 may be incorporated according to the present invention to provide a removable connection between the members 192 and 194.

A further aspect of the present invention includes embodiments wherein the forward member 192 is intended to absorb energy of debris expended by the projectile or target at close range, e.g. when the gun barrel attachment is in direct contact with a target, e.g. a door lock, etc., the member having the sharp edges (e.g. forward member 192) comprises a deformable material, e.g. 6061 Aluminum, topically softer or more malleable than steel. The support provided by the gun attachment against a hard target according to the present invention also sacrificially absorbs the energy of flying debris release by barrel projectile impact, and in some cases, absorbs such debris while spacing the gun barrel from the target and thus reducing the opportunity to damage the gun barrel from the debris. Exemplary embodiments illustrated and described above and other embodiments made according to the present invention may be formed from type 6061 (or other type) in their entirety or partially, such as the leading edges (and optionally the support thereof), the remaining portions being made of other material, including metals, plastics natural and composite materials.

Further modifications and substitutions made by one of ordinary skill are within the scope of the present invention, which is not limited except by the claims which follow.

What is claimed is:

1. A gun barrel attachment, comprising:

a tubular body including a recess extending therethrough, said tubular body comprising:

a front circumferential edge including a plurality of substantially contiguous serrations therealong, wherein said serrations include a sharp edge disposed substantially in line to form said circumferential edge; and a rear portion including barrel gripping means, wherein said front circumferential edge diminishes in radial thickness for increasing axial distances relative to said rear portion, to form said sharp edge.

2. The gun barrel attachment of claim 1, wherein said serrations wherein each said serrations are disposed between other serrations to substantially encircle said recess, and each said serration includes a curved sharp edge receding toward said rear portion, and said serrations encircling said recess together with said curved sharp edged are disposed to form axially directed tips therebetween.

3. The gun barrel attachment of claim 2, wherein said tips are truncated.

4. The gun barrel attachment of claim 1, wherein said barrel gripping means comprises circumferential clamp.

5. The gun barrel attachment of claim 4, wherein said barrel gripping means includes a axially disposed shoulder having a lesser interior diameter than said clamp.

6. The gun barrel attachment of claim 1, further including an intermediate region halving a reduced opening area, disposed between said barrel gripping means and said front circumferential edge.

7. The gun barrel attachment of claim 6, wherein said intermediate region includes a plurality openings disposed about the circumference of said intermediate region.

8. The gun barrel attachment of claim 7, wherein said plurality of openings comprise elongated openings.

9. The gun barrel attachment of claim 8, wherein said tubular body comprises an axis, and the longer dimension of said elongated openings extends parallel to said axis.

10. The gun barrel attachment of claim 1, wherein said tubular body comprises a plurality of separable sections including a forward section having said front circumferential edge and a rear section including said rear portion, and releasable means to secure said plurality of separable sections together.

11. The gun barrel attachment of claim 10, wherein said releasable means comprises screw threads disposed on one of said plurality of separable sections, and complementary threads disposed on a mating one of said plurality of separable sections.

12. The gun barrel attachment of claim 1, wherein front circumferential edge comprises aluminum.

13. The gun barrel attachment of claim 1 wherein said barrel gripping means comprises an opening dimensioned to attach to an auxiliary device disposed on said gun barrel.

14. The gun barrel attachment of claim 1, wherein said tubular body includes a forward recess and a circumferential light source therein.

15. A gun barrel attachment, comprising:

a tubular body including a recess extending therethrough and having a corresponding axis;

a tip comprising a tubular member axially received in said tubular body and having a front circumferential edge including a plurality of substantially contiguous serrations therealong, wherein said serrations include a sharp edge disposed substantially in line along the circumference of said circumferential edge; and a rear portion including barrel gripping means.

16. The gun barrel attachment of claim 15, further including a spring disposed between a portion of said tip and a portion of said tubular body.

17. The gun barrel attachment of claim 16, further including a retainer permitting selectively limited axial movement of said tip relative to said body.

18. The gun barrel attachment of claim 15, wherein said tubular member includes a forward circumferential recess and a light source therein.

* * * * *